US007940945B2

(12) United States Patent
Callias et al.

(10) Patent No.: US 7,940,945 B2
(45) **Date of Patent: *May 10, 2011**

(54) METHOD FOR OPERATING A WIRELESS AUDIO SIGNAL RECEIVER UNIT AND SYSTEM FOR PROVIDING HEARING ASSISTANCE TO A USER

(75) Inventors: Francois Callias, Fontaines (CH); Evert Dijkstra, Fontaines (CH); Francois Marquis, Oron-le-Chatel (CH)

(73) Assignee: Phonak AG, Staefa (CH)

( * ) Notice: Subject to any disclaimer, the term of this patent is extended or adjusted under 35 U.S.C. 154(b) by 1175 days.

This patent is subject to a terminal disclaimer.

(21) Appl. No.: 11/428,938

(22) Filed: Jul. 6, 2006

(65) Prior Publication Data

US 2008/0009253 A1 Jan. 10, 2008

(51) Int. Cl.
*H04R 25/00* (2006.01)

(52) U.S. Cl. ..... 381/315; 381/312; 379/430

(58) Field of Classification Search ..... 381/312, 381/315, 316, 331; 379/430
See application file for complete search history.

(56) References Cited

U.S. PATENT DOCUMENTS

| | | | | |
|---|---|---|---|---|
| 3,659,056 | A * | 4/1972 | Morrison et al. | 381/315 |
| 4,539,439 | A * | 9/1985 | Strothmann et al. | 381/312 |
| 5,734,976 | A | 3/1998 | Bartschi et al. | |
| 6,694,034 | B2 * | 2/2004 | Julstrom et al. | 381/315 |
| 6,975,739 | B2 * | 12/2005 | Bogason et al. | 381/315 |
| 7,206,423 | B1 * | 4/2007 | Feng et al. | 381/312 |
| 7,302,069 | B2 * | 11/2007 | Niederdrank et al. | 381/312 |
| 7,512,383 | B2 | 3/2009 | Essabar et al. | |
| 7,715,577 | B2 * | 5/2010 | Allen et al. | 381/312 |

FOREIGN PATENT DOCUMENTS

| | | | |
|---|---|---|---|
| CA | 2422449 | A1 | 3/2003 |
| EP | 1638367 | A2 | 3/2006 |
| EP | 1691574 | A2 * | 8/2006 |
| WO | 97 21325 | A1 * | 6/1997 |
| WO | 02/23948 | A1 | 3/2002 |
| WO | 02 30153 | A1 | 4/2002 |

OTHER PUBLICATIONS

Notification Concerning Transmittal of International Preliminary Report on Patentability, International Preliminary Report on Patentability, Wrtten Opinion of the International Searching Authority for International Application No. PCT/EP2006/006634 Dated Sep. 24, 2009.

* cited by examiner

*Primary Examiner* — Suhan Ni
(74) *Attorney, Agent, or Firm* — Roberts Mlotkowski Safran & Cole, P.C.; David S. Safran

(57) ABSTRACT

There is provided a method for operating a receiver unit (12) for receiving audio signals from a remote transmission unit (10) via a wireless audio link (56), comprising: connecting an audio signal output (41) of the receiver unit (12) to an audio signal input (42) of a hearing instrument (14A, 14B) comprising means (52) located at a user's ear or in the user's ear canal for stimulating the user's hearing according to the audio signals from the receiver unit (12) and a microphone arrangement (44); measuring by means (34, 38) included in the receiver unit (12) the impedance of the audio signal input (42) of the hearing instrument (14A, 14B); and adjusting the impedance of the audio signal output (41) of the receiver unit (12) according to the measured impedance of the audio signal input (42) of the hearing instrument (14A, 14B).

31 Claims, 2 Drawing Sheets

METHOD FOR OPERATING A WIRELESS AUDIO SIGNAL RECEIVER UNIT AND SYSTEM FOR PROVIDING HEARING ASSISTANCE TO A USER

BACKGROUND OF THE INVENTION

1. Field of the Invention

The present invention relates to a method for operating a receiver unit for receiving audio signals from a remote transmission unit via a wireless audio link, wherein an audio signal output of the receiver unit is connected to an audio signal input of a hearing instrument comprising means located at a user's ear or in the user's ear canal for stimulating the user's hearing according to the audio signals from the receiver unit. The invention also relates to a system for providing hearing assistance to a user, comprising a remote transmission unit, a receiver unit for receiving audio signals from the transmission unit via a wireless audio link, a hearing instrument, means for connecting an audio signal output of the receiver unit to an audio signal input of the hearing instrument, wherein the hearing instrument comprises means located at a user's ear or in the user's ear canal for stimulating the user's hearing according to the audio signals from the receiver unit.

2. Description of Related Art

Usually in such systems the wireless audio link is an FM radio link. The benefit of such systems is that sound captured by a remote microphone at the transmission unit can be presented at a high sound pressure level to the hearing of the user wearing the receiver unit at his ear(s). In particular, the microphone of the hearing instrument can be supplemented or replaced by the remote microphone which produces audio signals which are transmitted wirelessly to the FM receiver and thus to the hearing instrument. In particular, FM systems have been standard equipment for children with hearing loss in educational settings for many years. Their merit lies in the fact that a microphone placed a few inches from the mouth of a person speaking receives speech at a much higher level than one placed several feet away. This increase in speech level corresponds to an increase in signal-to-noise ratio (SNR) due to the direct wireless connection to the listeners amplification system. The resulting improvements of signal level and SNR in the listeners ear are recognized as the primary benefits of FM radio systems, as hearing-impaired individuals are at a significant disadvantage when processing signals with a poor acoustical SNR.

Most FM systems in use today provide two or three different operating modes. The choices are to get the sound from: (1) the hearing instrument microphone alone, (2) the FM microphone alone, or (3) a combination of FM and hearing instrument microphones together.

Usually, most of the time the FM system is used in mode (3), i.e. the FM plus hearing instrument combination (often labeled "FM+M" or "FM+ENV" mode). This operating mode allows the listener to perceive the speaker's voice from the remote microphone with a good SNR while the integrated hearing instrument microphone allows to listener to also hear environmental sounds. This allows the user/listener to hear and monitor his own voice, as well as voices of other people or environmental noise, as long as the loudness balance between the FM signal and the signal coming from the hearing instrument microphone is properly adjusted. The so-called "FM advantage" measures the relative loudness of signals when both the FM signal and the hearing instrument microphone are active at the same time. As defined by the ASHA (American Speech-Language-Hearing Association 2002), FM advantage compares the levels of the FM signal and the local microphone signal when the speaker and the user of an FM system are spaced by a distance of two meters. In this example, the voice of the speaker will travel 30 cm to the input of the FM microphone at a level of approximately 80 dB-SPL, whereas only about 65 dB-SPL will remain of this original signal after traveling the 2 m distance to the microphone in the hearing instrument. The ASHA guidelines recommend that the FM signal should have a level 10 dB higher than the level of the hearing instrument's microphone signal at the output of the user's hearing instrument.

When following the ASHA guidelines (or any similar recommendation), the relative gain, i.e. the ratio of the gain applied to the audio signals produced by the FM microphone and the gain applied to the audio signals produced by the hearing instrument microphone, has to be set to a fixed value in order to achieve e.g. the recommended FM advantage of 10 dB under the above-mentioned specific conditions. Accordingly, heretofore—depending on the type of hearing instrument used—the audio output of the FM receiver has been adjusted in such a way that the desired FM advantage is either fixed or programmable by a professional, so that during use of the system the FM advantage—and hence the gain ratio—is constant in the FM+M mode of the FM receiver.

CA 2422449 A1 relates to an example of such an FM receiver which not only receives audio signals from a remote microphone transmitter but in addition may communicate with remote devices such as a remote control or a programming unit via wireless link for data transmission.

EP 1 638 367 A2 relates to another example of an FM receiver for receiving audio signals from a remote microphone transmitter, wherein the FM receiver upon receipt of a polling signal from the remote microphone transmitter is capable of transmitting status information regarding the FM receiver to the remote microphone transmitter.

A further example of an FM receiver for receiving audio signals from a remote microphone transmitter is known from U.S. Pat. No. 5,734,976, wherein the FM receiver is equipped with a squelch function by which the audio signal in the receiver is muted if there is excessive noise due to a large distance between the transmission unit and the receiver unit exceeding the reach of the FM link.

WO 97/21325 A1 relates to a hearing system comprising a remote unit with a microphone and an FM transmitter and an FM receiver connected to a hearing aid equipped with a microphone. The hearing aid can be operated in three modes, i.e. "hearing aid only", "FM only" or "FM+M". In the FM+M mode the maximum loudness of the hearing aid microphone audio signal is reduced by a fixed value between 1 and 10 dB below the maximum loudness of the FM microphone audio signal, for example by 4 dB. Both the FM microphone and the hearing aid microphone may be provided with an automatic gain control (AGC) unit.

WO 02/30153 A1 relates to a hearing system comprising an FM receiver connected to a digital hearing aid, with the FM receiver comprising a digital output interface in order to increase the flexibility in signal treatment compared to the usual audio input parallel to the hearing aid microphone, whereby the signal level can easily be individually adjusted to fit the microphone input and, if needed, different frequency characteristics can be applied.

Depending on the type of hearing instrument, there are generally two alternatives of how the audio output of the receiver unit is connected to the audio input of the hearing instrument: On the one hand, there are hearing instruments having an audio input which is parallel to the microphone of the hearing instrument and hence has a relatively low input impedance. On the other hand, there are hearing instruments having an audio input which is separate from the microphone of the hearing instrument and which has a relatively high input impedance. In the first case, the microphone of the hearing instrument can be muted by setting the output impedance of the receiver unit to a relatively low value ("FM only" mode), while in the "FM+M" mode the output impedance of the receiver unit is set to a relatively high value in order to allow mixing of the audio output signals of the receiver unit and the hearing instrument microphone signals at comparable levels. The appropriate switching of the output impedance of the receiver unit usually is provided by a manually operable switch at the receiver unit.

In the first case, i.e. in the case of a hearing instrument having a low impedance audio input, one practical problem is that the achieved audio signal levels are often not identical in the "FM only" mode and in the "FM+M" mode. This is caused by tolerances of the audio input impedance of the hearing instrument due to variations of the impedance of the microphone of the hearing instrument and by the fact that the audio output impedance of the receiver unit is fixed and also has tolerances. Practically, a spread of the hearing instrument input impedance as large as from 2 kOhm to 11 kOhm has been measured. Usually the desired FM advantage, which theoretically could be predetermined by setting the gain applied to the audio signals in the receiver unit and/or the audio output impedance of the receiver unit accordingly, in practice is achieved only for a hearing instrument having a microphone which has exactly the impedance value (e.g. 3.9 kOhm) assumed when setting the gain and/or audio output impedance. In other words, in practice the desired FM advantage usually will not be achieved due to the practical variations of the audio input impedance of the hearing instrument.

In the second case, i.e. in the case of a hearing instrument having a high impedance audio input, switching between the "FM only" mode and the "FM+M" mode is done within the hearing instrument. In this case, the output impedance of the receiver unit should be set to the low value in order to achieve the desired FM-advantage. If the receiver unit is used at the high output impedance setting, the desired FM-advantage will not be achieved.

A further problem occurring with FM systems results from the fact that the receiver unit has to be mechanically and electrically connected to the hearing instrument, usually via a so-called "audio shoe". It may happen that there is no electrical connection between the audio output of the receiver unit and the audio input of the hearing instrument. In this case the wireless audio link will not be working, which, however, may not be recognized by the user, in particular if the user is a child.

It is an object of the invention to provide for a method for operating a receiver unit for receiving audio signals from a remote transmission unit via a wireless audio link, which receiver unit is connected to an audio signal input of a hearing instrument, wherein variations of the actually provided audio signal level due to variations of the input impedance of the hearing instrument should be reduced. It is a further object to provide for such a receiver unit.

These objects are achieved by a method as defined in claim 1 and a receiver unit as defined in claim 28, respectively.

SUMMARY OF THE INVENTION

The invention is beneficial in that, by measuring the impedance of the audio signal input of the hearing instrument by means included in the receiver unit and by adjusting the impedance of the audio signal output of the receiver unit according to the measured impedance of the audio signal input of the hearing instrument, the impedance of the audio signal output of the receiver unit can be automatically adapted to the actual impedance of the audio signal input of the hearing instrument, so that the desired audio signal level can be automatically achieved regardless of the practical variations of the impedance of the audio signal input of the hearing instrument. In particular, the receiver unit is enabled to automatically detect to which kind of audio input (either high impedance input or low impedance input) the receiver unit has been connected in order to automatically set the output impedance accordingly, so that specifically in the case in which the receiver unit connected to a high impedance audio signal input automatically the appropriate output impedance is set without the need for operation of a corresponding switch by the user. In case of connection to a low impedance audio input, the practical variations of the impedance of the hearing instrument microphone can be automatically compensated for, so that the audio signal level in the "FM only" and in the "FM+M" mode can be balanced automatically. In addition, by measuring the impedance of the audio signal input of the hearing instrument the receiver unit is enabled to automatically detect if there is no connection between the receiver unit and the hearing instrument, so that, for example, a corresponding alarm signal can be issued. Similarly, also the case in which there is a short-circuit connection between the receiver unit and the hearing instrument can be detected automatically.

Preferred embodiments of the invention are defined in the dependent claims. These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
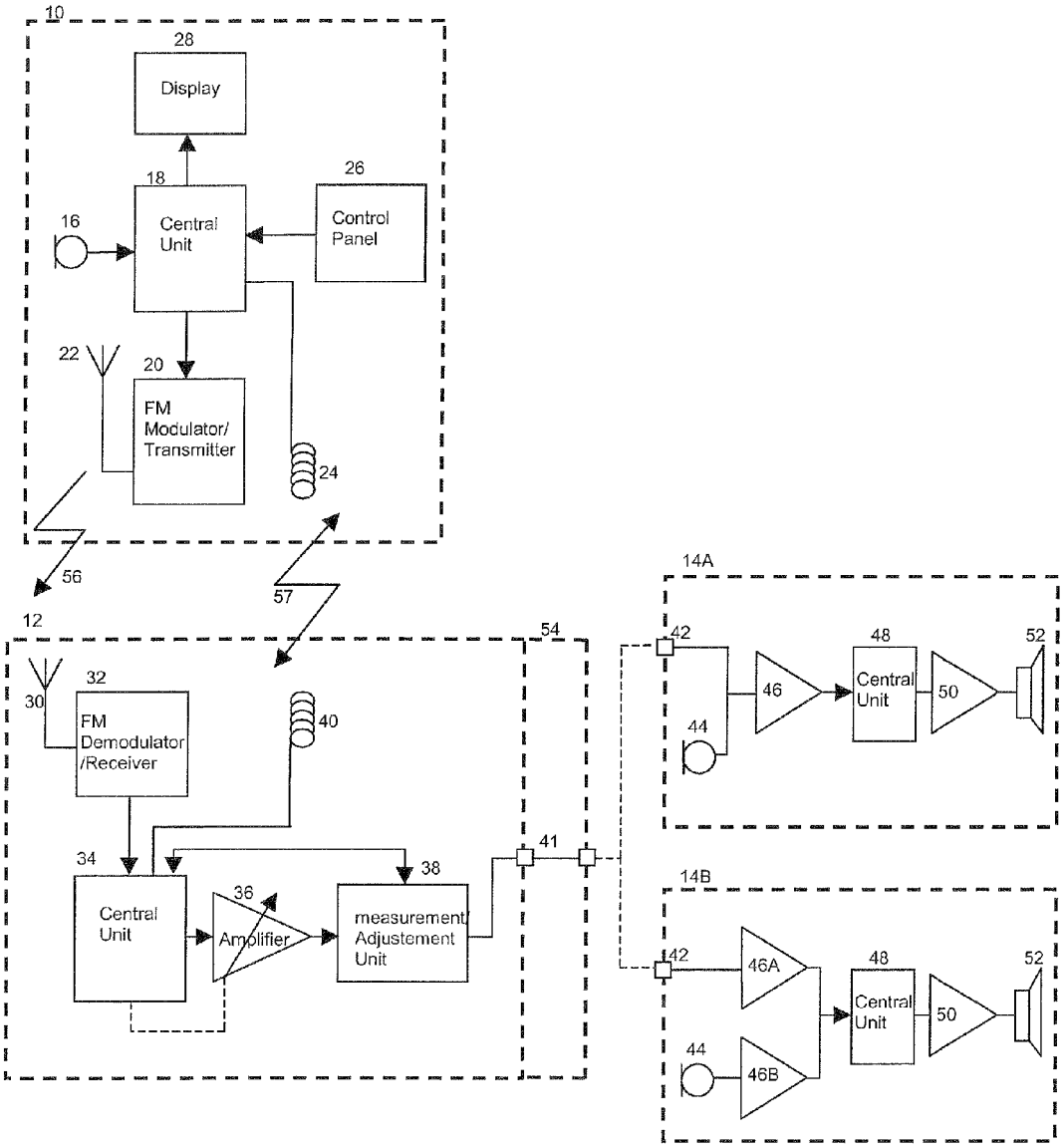
FIG. 1 is a block diagram of a wireless hearing assistance system comprising a receiver unit according to the invention, wherein two alternative ways of connecting the receiver unit to the hearing instrument are shown.

FIG. 1 shows a block diagram of an example of a system for providing hearing assistance to a user which comprises a remote transmission unit 10, a receiver unit 12 and two alternative examples of a hearing instrument 14A and 14B, respectively. The transmission unit 10 comprises a microphone arrangement 16 (which may consist of at least two spaced apart microphones for achieving acoustic beam forming capability), a central unit 18 for processing the audio signals captured by the microphone arrangement 16 and for controlling the transmission unit 10, a transmitter/modulator 20, an FM antenna 22, an inductive antenna 24, a control panel 26 and a display 28.

The receiver unit 12 comprises an FM antenna 30, a receiver/demodulator 32, a central unit 34, an amplifier 36, a measurement/adjustment unit 38, an inductive antenna 40 and an audio signal output 41.

The hearing instrument 14A comprises an audio input 42, a microphone arrangement 44 (which usually comprises at least two spaced-apart microphones for achieving acoustic beam forming capability) connected in parallel to the audio input 42, a pre-amplifier 46, a central unit 48, a power amplifier 50 and an output transducer for stimulating the user's hearing, which usually will be a loudspeaker. In the hearing instrument 14A the audio input 42 has a relatively low impedance.

The hearing instrument 14B differs from the hearing instrument 14A essentially in that the audio input 42 has a relatively high impedance and thereby is essentially separated from the microphone arrangement 44. The signals supplied to the audio input 42 are amplified by a pre-amplifier 46A, while the audio signals captured by the microphone arrangement 44 are amplified by a pre-amplifier 46B, with the respective amplified signals being combined prior to being supplied to the central unit 48.

The values of the impedance of the audio input 42 of the hearing instrument 14B may range from 20 kOhm to 100 kOhm, whereas typical values for the impedance of the audio input 42 of the hearing instrument 14A are from 2 kOhm to 15 kOhm, in which case the impedance is determined by the impedance of the microphone arrangement 44.

The audio signal output 41 of the receiver unit 12 usually is electrically connected to the audio input 42 via an interface 54 which usually also serves to mechanically connect the receiver unit 12 to the hearing instrument 14A, 14B. Such interface usually is a so-called "audio shoe". The hearing instrument 14A, 14B may be of any type, e.g. behind the ear (BTE), in the ear (ITE) or completely in the channel (CIC).

The transmission unit 10 may be for use by another person, for example, a teacher in a classroom, or it may be for use by the user of the hearing instrument 14A, 14B. In the latter case, the user, for example, may put the transmission unit 10 on a table in front of him, he may hold it in his hand or he may wear it somewhere at his body. In addition to the microphone arrangement 16, the transmission unit 10 may be adapted for receiving audio signals from a remote source, for example, from a mobile phone via a "Bluetooth" link (not shown in FIG. 1).

In normal operation of the system, the audio signals captured by the microphone arrangement 16 are processed in the central unit 18 and then are modulated in the transmitter 20 for being transmitted via the antenna 22 over a wireless audio link 56 to the antenna 30. Usually the audio link 56 is a narrow band FM link. The signals received at the antenna 30 are demodulated in the demodulator 32, and the demodulated audio signals are processed in the central unit 34 prior to being amplified in the amplifier 36. The audio signals then pass through the unit 38 to the audio output 41 and from there via the audio input 42 and the pre-amplifier 46/46A to the central unit 48 for being processed there. The processed audio signals are amplified in the power amplifier 50 and then are reproduced by the output transducer 52 as sound stimulating the user's hearing.

Usually the gain provided to the audio signals in the receiver unit 12 by the amplifier 36 will be constant. However, according to a modified embodiment, the amplifier 36 may be a variable gain amplifier which is controlled by the central unit 34 according to control commands sent from the transmission unit 10, for example, via the FM link 56. Such control commands may be generated manually by operating the control panel 26 accordingly or they may be generated according to an auditory scene analysis performed by the central unit 18 based on the audio signals captured by the microphone arrangement 16. Such a variable gain system is described in the pending European patent application 06 002 886.7.

One problem encountered by such wireless audio systems is the fact that the level at which the audio signals captured by the remote microphone arrangement 16 will be finally reproduced by the hearing instrument 14A, 14B—and in particular also the level relative to the audio signal level of the hearing instrument microphone arrangement 44—will not only depend on the gain applied in the receiver unit 12 by the amplifier 36 (which could be set accordingly during fitting of the receiver unit 12 or even during operation of a variable gain receiver unit 12) but also on the impedance of the audio input 42 of the hearing instrument 14A, 14B, which, however, may considerably differ for the specific type of hearing instruments 14A, 14B. In particular, the audio input impedance will be largely different depending on whether a hearing instrument 14A with a high impedance audio input 42 or a hearing instrument 14B with a low impedance audio input 42 is connected to the receiver unit 12.

In conventional receiver units the first problem (model and tolerance dependent variation of the audio input impedance, which is particularly significant for the type of low audio input impedance hearing instruments 14B) is not addressed, while the second problem (use of a high audio input impedance hearing instrument 14A or a low audio input impedance hearing instrument 14B) is addressed by providing a switch in the unit 38 by which the output impedance of the receiver unit 12 can be varied between a relatively low value which is used for connection to a high audio input impedance hearing instrument 14B and a relatively high output impedance which is used for connection with a low audio input impedance hearing instrument 14A in the "FM+M" mode (in which the user should hear both the audio signals from the receiver unit 12 and from the microphone arrangement 44). The low value of the output impedance in this case is used for muting the microphone arrangement 44 of the hearing instrument 14A in the "FM only" mode so that the user can hear only the audio signals from the receiver unit 12).

However, with such conventional receiver units, in practice often a problem arises in the case in which the receiver unit is connected to a low audio input impedance hearing instrument 14A, since in this case the levels of the audio signals from the receiver unit 12 are often not identical in the switch positions "FM-only" and "FM+M" due to model and tolerance dependent variations of the impedance of the microphone arrangement 44.

Figure 2:
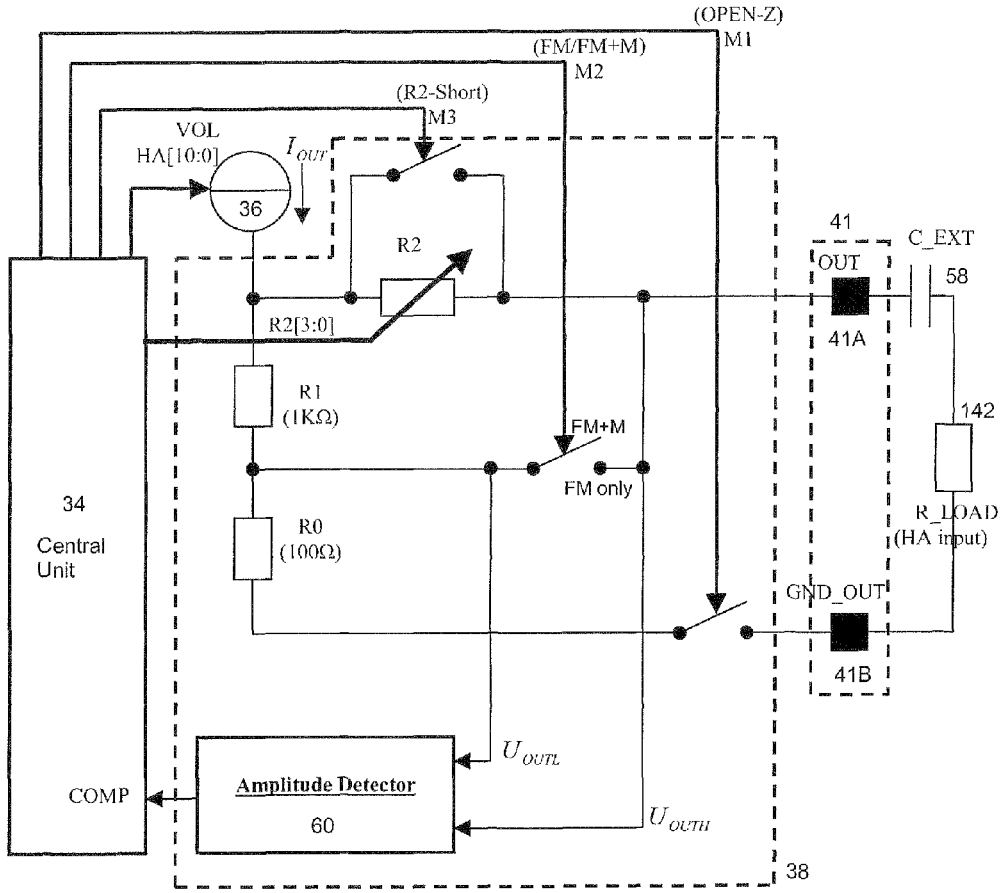
FIG. 2 is a schematic example of how the receiver unit may be provided with a circuit for measuring the impedance of the audio signal input of the hearing instrument and for adjusting accordingly the impedance of the audio signal output of the receiver unit.

FIG. 2 shows a schematic example of how the unit 38 may be designed in order to avoid this problem. In the representation of FIG. 2, the amplifier 36 is represented by a current source 36 and the impedance of the audio input 42 is represented by an impedance 142. The audio output 41 of the receiver unit 12 comprises an audio signal pin 41A and a ground pin 41B. In practice there is always a capacitor 58 in series to the impedance 142, the value of which will depend on the hearing instrument model.

The measurement/adjustment unit 38 comprises a switch M1 for setting the output impedance to a high value when the receiver unit 12 is in a stand-by or OFF-mode, a lower resistance resistor R0 which may have, for example, a value of 100 Ohm, a higher resistance resistor R1 which, for example, may have a value of 1 kOhm, a variable resistance resistor R2, a switch M3 for bypassing the variable resistor R2, a switch M2 for switching between the "FM-only" and "FM+M" mode, and an amplitude detector 60.

The open position of the switch M2 sets the "FM+M" mode, while the closed position sets the "FM only" mode. In the "FM only" mode the output impedance of the receiver unit 12 is determined by the resistor R0, while in the "FM+M" mode the output resistance is primarily determined by the resistor R2. In the "FM only" mode the resistor R0 is connected in parallel to the input impedance 142, while in the "FM+M" mode a serial connection of the resistors R2, R1 and R0 is connected in parallel to the input impedance 142.

The unit 38 has two functions: (1) the input impedance of the audio input 42, i.e. the value of the load impedance 142, is to be measured and (2) the output impedance of the receiver unit 12 is to be adjusted according to the determined value of the input impedance by adjusting the variable resistor R2 accordingly. To this end, a signal indicative of the input impedance is supplied to the central unit 34 which, in turn, acts on the variable resistor R2 to adjust the output impedance and which may generate a status signal indicative of the type of audio input to which the receiver unit is connected, as will be discussed in more detail below.

For performing a measurement of the input impedance, the switch M1 is closed, the switch M3 is opened and the switch M2 is opened by the central unit 34, i.e. the output impedance is set to that of the "FM+M" mode. The central unit 34 will cause the output signal of the demodulator 32 to be muted. In view of the serial capacitance 58 the measurement will be carried out with an AC signal, for example, a simple sine wave signal at a frequency, for example between 1 kHz and 10 kHz. The measurement frequency preferably is programmable, since there is some uncertainty of the value of the capacitive load 58 which depends on the hearing instrument model. A frequency of 10 kHz usually will be attenuated by the hearing instrument 14A, 14B by more than 40 dB due to the usual pass-band of 100 Hz to 6 kHz and therefore will not be perceived at all by the user of the hearing instrument. In view of the fact that the microphone arrangement 44 of the hearing instrument 14A, 14B will be fully operating during the impedance measurement, the test signal is used at a relatively high level corresponding, for example, to a sound pressure level of at least 85 dB or 90 dB at the microphone. The measurement typically will have a duration of less than 200 msec.

The principle of the impedance measurement is to vary the value of the variable resistor R2 while measuring the voltage levels $U_{OUTL}$ on the low output impedance line (corresponding to the output impedance in the closed position of the switch M2, i.e. "FM only" mode) and $U_{OUTH}$ on the high output impedance line (open position of the switch M2, i.e. "FM+M" mode). These two voltage levels are compared in the amplitude detector 60, the output signal of which is provided to the central unit 34. The amplitude detector 60 may be implemented, for example, as an A/D-converter followed by a logic or a digital signal processor, or it may be implemented as peak level detectors followed by a decision logic. If it is detected that the levels $U_{OUTL}$ and $U_{OUTH}$ are equal, this means that the signal output level is balanced for both positions of the switch M2 (i.e. for both the "FM-only" mode and the "FM+M" mode), so that the respective value of the variable resistor RE should be used as the output impedance in the "FM+M" mode.

In the following, an example of a measurement sequence is given.

The measurement may start with a connection integrity check for which the variable resistor R2 is set to its highest value, for example, 1.2 MOhm. If it is found by the amplitude detector 60 that $U_{OUTH}$ is equal to or larger than $U_{OUTL}$, it is decided that no connection to an audio input of a hearing instrument exists, whereupon the measurement is terminated and a corresponding status signal indicating "no connection" is issued.

If it is found that $U_{OUTH}$ is less than $U_{OUTL}$, it is checked whether the audio input is a high impedance audio input by setting the variable resistor R1 to, for example, 150 kOhm. If it is found that $U_{OUTH}$ is equal to or larger than $U_{OUTL}$, it is decided that the receiver unit 12 is connected to a high impedance (i.e. separate) audio input, whereupon the measurement is terminated and a corresponding status signal indicating "connection to high impedance audio input" is issued.

If it is found that $U_{OUTH}$ is less than $U_{OUTL}$, it is checked whether the receiver unit 12 is connected to a low impedance audio input, i.e. to a microphone arrangement 44 of the hearing instrument 14A, by setting the variable resistor R2 to a lower value, for example, 127 kOhm. If it is found that $U_{OUTH}$ is equal to or larger than $U_{OUTL}$, it is decided that the receiver unit 12 is connected to a low impedance audio input, whereupon the measurement is terminated and a corresponding status signal "connection to low impedance audio input" is generated.

If it is detected that $U_{OUTH}$ is less than $U_{OUTL}$, the value of the variable resistor R2 is further reduced, for example, to 108 kOhm, and the steps described above for the value of 127 kOhm are repeated, and so on. The value of the variable resistor R2 may be gradually reduced in, for example, 14 logarithmic steps downward to a value of R2 of 15 kOhm.

If even for the lowest value of R2 it is found that $U_{OUTH}$ is less than $U_{OUTL}$, it is decided that there is a short circuit between the pins 41A and 41B, whereupon the measurement is terminated and a corresponding status signal indicating "short circuit connection" is issued.

If the value of R2 at which $U_{OUTH}$ has been found to be equal to or larger than $U_{OUTL}$ was between 127 kOhm and 15 kOhm, the respective value of R2 is set by the central unit 34 for operating the receiver unit 12 in the "FM+M" mode.

If it has been found that the receiver unit 12 is connected to a high impedance audio input, switch M2 is set by the central unit 34 to the closed position, i.e. the output impedance is set to the low value determined by the resistor R0.

Figure 3:
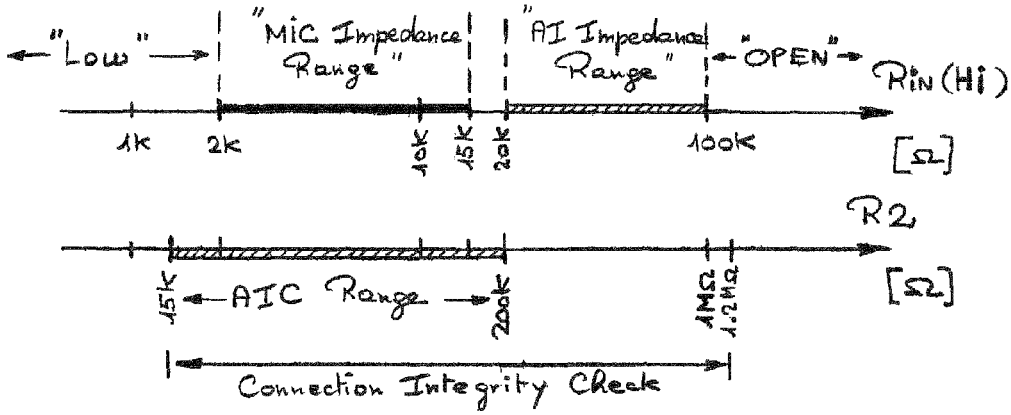
FIG. 3 shows an example of how the measured audio input impedance of the hearing instrument may be classified.

FIG. 3 gives a practical example of how the measured audio input impedance of the hearing instrument may be classified, with the actual impedance R_LOAD of the audio input, i.e. the value of the impedance 142, being shown together with the corresponding setting of the resistance of the variable resistor R2, i.e. the setting of the resistance of the resistor R2 for which for a given impedance R_LOAD of the audio input $U_{OUTH}$ equals $U_{OUTL}$. For such condition, R2 equals (R1/R0) *R_LOAD, i.e. in the example of FIGS. 2 and 3 R2=10*R_LOAD.

According to FIG. 3, for values of R_LOAD less than 1.5 kOhm (R2 less than 15 kOhm) the connection status is evaluated as "short circuit connection", for values of R_LOAD from 1.5 kOhm to less than 15 kOhm (R2 from 15 kOhm to less than 150 kOhm) the connection status is evaluated as "low impedance audio input connection", for values of R_LOAD from 15 kOhm to less than 120 kOhm (R2 from 150 kOhm to less than 1.2 MOhm) the connection status is evaluated as "high impedance audio input connection", and for values of R_LOAD equal to or greater than 120 kOhm (R2 equal to or greater than 1.2 MOhm) the connection status is evaluated as "no connection".

The inductive antenna 40 of the receiver unit 12 is provided for establishing a bidirectional data link to an external device, for example, the remote transmission unit 10 in order to transmit control commands from the remote transmission unit 10 via the inductive antenna 24 to the central unit 34 of the receiver unit 12 and to transmit the status signal indicative of the audio output connection status of the receiver unit 12 from the receiver 12 to the remote transmission unit 10. The received status signal may be converted to corresponding signal to be displayed on the display 28, for example, to an alarm signal indicating "no connection" or "short circuit connection".

Generally, the measurement of the audio input impedance and the respective adjustment of the audio output impedance by the receiver unit 12 may be initiated by an external command, for example, received via the inductive link 57, or it may be initiated automatically upon start-up of the receiver unit 12. For example, the receiver unit 12 may be designed such that the connection integrity check (in which the resistor R2 is set to the highest value) may be performed only upon request via the inductive link 57, while the audio impedance calibration, i.e. the measurement of the audio input impedance in order to adjust the audio output impedance accordingly, may be performed on request via the inductive link 57 or it may be performed automatically upon start-up of the receiver unit 12. However, the latter only makes sense if the receiver unit 12 is connected to a low impedance audio input.

The inductive link may be, for example, a 41 kHz link.

The remote device connected via the inductive link 57 to the receiver unit 12, rather than being part of the remote transmission unit 10, also could be a separate remote control or remote programming unit for the receiver unit 12.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A method for operating a receiver unit for receiving audio signals from a remote transmission unit via a wireless audio link, comprising:

connecting an audio signal output of said receiver unit to an audio signal input of a hearing instrument comprising means located at a user's ear or in a user's ear canal for stimulating said user's hearing according to the audio signals from said receiver unit and a microphone arrangement;

measuring by means included in said receiver unit an impedance of said audio signal input of said hearing instrument; and adjusting an impedance of said audio signal output of said receiver unit according to the measured impedance of said audio signal input of said hearing instrument; and wherein said connecting step comprises electrically connecting the audio signal output of the receiver unit to the audio input of the hearing instrument via an interface which also mechanically connects the receiver unit to the hearing instrument.

2. The method of claim 1, wherein said output impedance of said receiver unit is adjusted such that a predetermined audio signal output level is achieved.

3. The method of claim 1, wherein the measured impedance of said audio signal input of said hearing instrument is classified into categories in order to generate a status signal representative of a connection status of said audio signal output of said receiver unit.

4. The method of claim 3, wherein said status signal is indicative of a type of audio input to which said receiver unit is connected.

5. The method of claim 3, wherein said status signal is indicative of a quality of a connection of said audio signal output to said audio input of said hearing instrument.

6. The method of claim 3, wherein the categories of said status signal include: "no connection" if the measured audio input impedance is equal to or higher than a first threshold, "connection to a high impedance audio input separate from the microphone arrangement of the hearing instrument" if the measured audio input impedance is equal to or higher than a second threshold but less than said first threshold, "connection to a low impedance audio input parallel to the microphone arrangement of the hearing instrument" if the measured audio input impedance is equal to or higher than a third threshold but less than said second threshold, and "short circuit connection" if the measured audio input impedance is less than said third threshold.

7. The method of claim 6, wherein an alarm signal is generated if the measured impedance of said audio signal input of said hearing instrument has been classified into the categories "no connection" or "short circuit connection".

8. The method of claim 3, wherein the measurement of said impedance of said audio signal input of said hearing instrument is initiated by a command received via an inductive link from a remote device.

9. The method of claim 8, wherein said status signal is transmitted via said inductive link from said receiver unit to said remote device.

10. The method of claim 1, wherein said impedance of said audio signal input of said hearing instrument is measured with alternating current.

11. The method of claim 10, wherein said impedance of said audio signal input of said hearing instrument is measured at least two different frequencies.

12. The method of one claim 1, wherein said impedance of said audio signal input of said hearing instrument is measured at an audio signal level corresponding to a microphone sound pressure level of at least 85 dB.

13. The method of claim 1, wherein during the measurement of said impedance of said audio signal input of said hearing instrument said microphone arrangement of said hearing instrument is fully working.

14. The method of claim 1, wherein the measurement of said impedance of said audio signal input of said hearing instrument is automatically initiated when said receiver unit is turned on.

15. The method of claim 1, wherein said audio signals received at said receiver unit are muted during measuring the impedance of said audio signal input of said hearing instrument.

16. The method of claim 1, wherein said wireless audio link is a Radio Frequency link, such as a Frequency Modulation link.

17. A method for operating a receiver unit for receiving audio signals from a remote transmission unit via a wireless audio link, comprising:

connecting an audio signal output of said receiver unit to an audio signal input of a hearing instrument comprising means located at a user's ear or in a user's ear canal for stimulating said user's hearing according to the audio signals from said receiver unit and a microphone arrangement;

measuring by means included in said receiver unit an impedance of said audio signal input of said hearing instrument;

adjusting an impedance of said audio signal output of said receiver unit according to the measured impedance of said audio signal input of said hearing instrument;

wherein said output impedance of said receiver unit is adjusted such that a predetermined audio signal output level is achieved, and wherein said output impedance of said receiver unit is set to a pre-determined first value if connection to a high impedance audio input separate from said microphone arrangement of said hearing instrument has been detected by measuring a value of said audio input impedance less than a first threshold but equal to or higher than a second threshold.

18. The method of claim 17, wherein said output impedance of said receiver unit is set to said pre-determined first value by setting a first switch to a first position.

19. The method of claim 18, wherein by setting said first switch to said first position a non-variable first resistor is connected in parallel to said audio input.

20. The method of claim 19, wherein said output impedance of said receiver unit is set to a value selected from a plurality of pre-determined values according to the measured audio input impedance if connection to a low impedance audio input parallel to said microphone arrangement of said hearing instrument has been detected by measuring a value of said audio input impedance equal to or higher than a third threshold but less than said second threshold.

21. The method of claim 20, wherein said output impedance of said receiver unit is set to said selected value by setting said first switch to a second position and by adjusting a variable resistor according to the measured audio input impedance.

22. The method of claim 21, wherein by setting said first switch to said second position a serial connection of said variable resistor, of said non-variable first resistor and of said non-variable second resistor is connected in parallel to said audio input.

23. The method of claim 22, wherein said audio input impedance is measured with said first switch being set to said second position.

24. The method of claim 23, wherein said audio input impedance is measured by varying a resistance of said variable resistor and comparing a voltage on said first non-variable resistor and a voltage on a serial connection of said second non-variable resistor and said variable resistor.

25. The method of claim 24, wherein said resistance of said variable resistor is varied in logarithmic steps.

26. The method of claim 24, wherein a value of said resistance of said variable resistor for which a pre-determined condition for a voltage on said first non-variable resistor and a voltage on said second non-variable resistor and said variable resistor is fulfilled is taken as representative of said audio input impedance.

27. The method of claim 24, wherein said resistance of said variable resistor is set to a value for which a pre-determined condition for a voltage on said first non-variable resistor and a voltage on said second non-variable resistor and said variable resistor is fulfilled in order to set said output impedance of said receiver unit to said selected value.

28. A receiver unit for receiving audio signals from a remote transmission unit via a wireless audio link, comprising:

an audio signal output adapted for being connected to an audio signal input of a hearing instrument comprising means to be located at a user's ear or in the user's ear canal for stimulating a user's hearing according to audio signals from the receiver unit;

means for measuring a impedance of said audio signal input of said hearing instrument; and means for adjusting an impedance of said audio signal output of said receiver unit according to the measured impedance of said audio signal input of said hearing instrument; and an interface with which the audio signal output of the receiver unit is electrically connectable to the audio input of the hearing instrument and with which the receiver unit is also mechanically connectable to the hearing instrument.

29. A system for providing hearing assistance to a user, comprising:

a receiver unit comprising:

an audio signal output adapted for being connected to an audio signal input of a hearing instrument comprising means to be located at a user's ear or in the user's ear canal for stimulating a user's hearing according to audio signals from the receiver unit;

means for measuring a impedance of said audio signal input of said hearing instrument and means for adjusting an impedance of said audio signal output of said receiver unit according to the measured impedance of said audio signal input of said hearing instrument;

a remote transmission unit, a hearing instrument; and means for connecting said audio signal output of said receiver unit to an audio signal input of said hearing instrument, said means comprising an interface with which the audio signal output of the receiver unit is electrically connected to the audio input of the hearing instrument and with which the receiver unit is also mechanically connected to the hearing instrument;

wherein said hearing instrument comprises means located at a user's ear or in a user's ear canal for stimulating a user's hearing according to said audio signals from said receiver unit.

30. The system of claim 29, wherein said remote transmission unit comprises a microphone arrangement for capturing audio signals which are to be transmitted to said receiver unit.

31. The system of claim 29, wherein said hearing instrument comprises a microphone arrangement for capturing audio signals and means for mixing said audio signals with audio signals provided at said audio signal input in order to provide the mixed audio signals to said stimulating means.

* * * * *